US006376936B1

(12) United States Patent
Thomas

(10) Patent No.: US 6,376,936 B1
(45) Date of Patent: Apr. 23, 2002

(54) SWITCHING APPARATUS FOR AN EXERCISE POWERED TV

(76) Inventor: Kurt R. Thomas, 14577 Laube Rd., Durand, IL (US) 61024

( * ) Notice: Subject to any disclaimer, the term of this patent is extended or adjusted under 35 U.S.C. 154(b) by 0 days.

(21) Appl. No.: 09/517,676

(22) Filed: Mar. 2, 2000

(51) Int. Cl.[7] ..... H01H 47/00
(52) U.S. Cl. ..... 307/125; 482/900
(58) Field of Search ..... 307/125, 129, 307/130, 131; 482/4, 8, 900, 901, 902

(56) References Cited

U.S. PATENT DOCUMENTS 5,456,648 A * 10/1995 Edinburg et al.

* cited by examiner

*Primary Examiner*—Edward H. Tso
(74) *Attorney, Agent, or Firm*—David J. Archer

(57) ABSTRACT

A switching apparatus is disclosed for switching on a TV as a reward when a user is achieving a predetermined performance level on an exercise apparatus. The switching apparatus includes a pulse generator for generating pulses commensurate with the amount of work expended by the user on the exercise apparatus and a transmitter for transmitting the pulses. A transceiver TV module receives the pulses from the transmitter, the transceiver module including a pulse counter for counting the pulses received from the transmitter, a power sensor for sensing the power status of the TV and a comparator circuit connected to the pulse counter and the power sensor such that when the power sensor senses the status of the TV as being inactive, the comparator circuit compares the pulses counted by the counter with a threshold level which corresponds with the predetermined factory preset performance level so that when the pulses reach the threshold level, a signal is generated and when the power sensor senses the status of the TV as being active, the comparator circuit compares the pulses with the threshold level such that when the pulses reach below the threshold level, a further signal is generated so that the module transmits the signal and the further signal accordingly. A receiver is disposed in operable proximity to the TV. The arrangement is such that when the receiver receives the signal, the TV is activated and when the further signal is received by the receiver, the TV is inactivated such that overriding the status of the TV is inhibited so that watching the TV without reaching the predetermined performance level is prevented.

7 Claims, 2 Drawing Sheets

I)

II)

III)

SWITCHING APPARATUS FOR AN EXERCISE POWERED TV

BACKGROUND OF THE INVENTION

Field of the Invention

The present invention relates to a switching apparatus for switching on a TV. More particularly, the present invention relates to a switching apparatus for switching on a TV as a reward when a user is achieving a predetermined performance level on an exercise apparatus.

INFORMATION DISCLOSURE STATEMENT

Due to the abundance of technological achievements in the last few decades, there is today a tendency to use machines to accomplish tasks that in past generations required the expenditure of much effort and hard work. For example, whereas people used to walk to work, now, they ride in automobiles. Consequently, many persons suffer from a lack of exercise and are often grossly overweight.

Although a plethora of exercise machines have been designed in an attempt to burn off excess calories, such machines are only effective if the user is able to develop a disciplined routine of exercise. However, because of the natural tendency of most persons to be easily distracted or to prematurely give up before a task is accomplished, the same problem exists with regard to the use of exercise machines. Users of such machines become easily bored or are distracted to a more relaxed use of their time. Several proposals have been suggested in which a person exercising is able to watch a TV show or the like during a workout. However, there exists a tendency during an exercise session for the mind to wander and become so absorbed in the TV show that the exercise routine is abandoned or is dwindled to a point where the would be exerciser is reduced to the equivalent of a couch potato.

The present invention seeks to overcome the aforementioned problem by the provision of a switching apparatus or system which links an exercise machine to a TV so that the TV is only switched on as a reward when a user is achieving a predetermined performance level on the exercise machine.

Therefore, it is a primary feature of the present invention to provide a switching apparatus that overcomes the problems associated with the prior art exercise arrangements and that provides a considerable contribution to the art of exercise machines.

Another feature of the present invention is the provision of a switching apparatus that prevents a user thereof from overriding the system and watching a TV program without reaching a predetermined performance level on the exercise machine.

Other features and advantages of the present invention will be readily apparent to those skilled in the exercise machine art by a consideration of the detailed description contained hereinafter taken in conjunction with the annexed drawings.

SUMMARY OF THE INVENTION

The present invention relates to a switching apparatus for switching on a TV as a reward when a user is achieving a predetermined performance level on an exercise apparatus. The switching apparatus includes a pulse generator for generating pulses commensurate with the amount of work expended by the user on the exercise apparatus and a transmitter for transmitting the pulses. A transceiver TV module receives the pulses from the transmitter, the transceiver module including a pulse counter for counting the pulses received from the transmitter. Additionally, the module includes a power sensor for sensing the power status of the TV and a comparator circuit connected to the pulse counter and the power sensor. When the TV is plugged in for the first time, the power sensor will determine the power required or power rating for any type of TV. The arrangement is such that when the power sensor senses the status of the TV as being inactive, the comparator circuit compares the pulses counted by the counter with a threshold level which corresponds with the predetermined and factory set performance level so that when the pulses reach a level of the threshold level, a signal is generated. However, when the power sensor senses the status of the TV as being active, the comparator circuit compares the pulses with the threshold level such that when the pulses reach a level that is less than the threshold level, a further signal is generated so that the module transmits the signal and the further signal accordingly. A receiver is disposed in operable proximity to the TV. The arrangement is such that when the receiver receives the signal, the TV is activated. Conversely, when the further signal is received by the receiver, the TV is inactivated such that overriding the status of the TV is inhibited so that watching the TV without reaching the predetermined performance level is prevented.

In a more specific embodiment of the present invention, the pulse generator generates the pulses which are electrical signals, the pulses increasing in proportion with the amount of work expended by the user during a unit of time. Also, the transmitter transmits the pulses as R.F. waves to the module.

The transceiver TV module further includes a selectively lockable housing, a power cord extending from the TV to within the lockable housing, an electrical circuit for electrically connecting the power cord to a source of electrical power. The module also includes a lock for locking the housing such that plugging the power cord directly into a source of electrical power is prevented so that the overriding of an inactive status of the TV is inhibited.

The power sensor senses the status of the TV as being active when the TV picture tube is on and as being inactive when the TV picture tube is off.

Moreover, the comparator circuit further includes means for checking the pulses if the status of the TV is active and if the pulses have dropped below the level of the threshold level. A time delay mechanism is included for delaying transmission of the further signal so that the status of the TV is deactivated after a predetermined period of time so that if the user momentarily relapses from achieving the predetermined performance level, the TV is not immediately deactivated.

The receiver includes a remote LED disposed in operable proximity to the TV, the remote LED controlling a remote actuation of the TV for switching the TV from an inactive to an active status, and an active to an inactive status as programmed.

Many modifications and variations of the present invention will be readily apparent to those skilled in the art by a consideration of the detailed description contained hereinafter taken in conjunction with the annexed drawings showing a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various drawings.

DETAILED DESCRIPTION OF THE DRAWINGS

Figure 1:
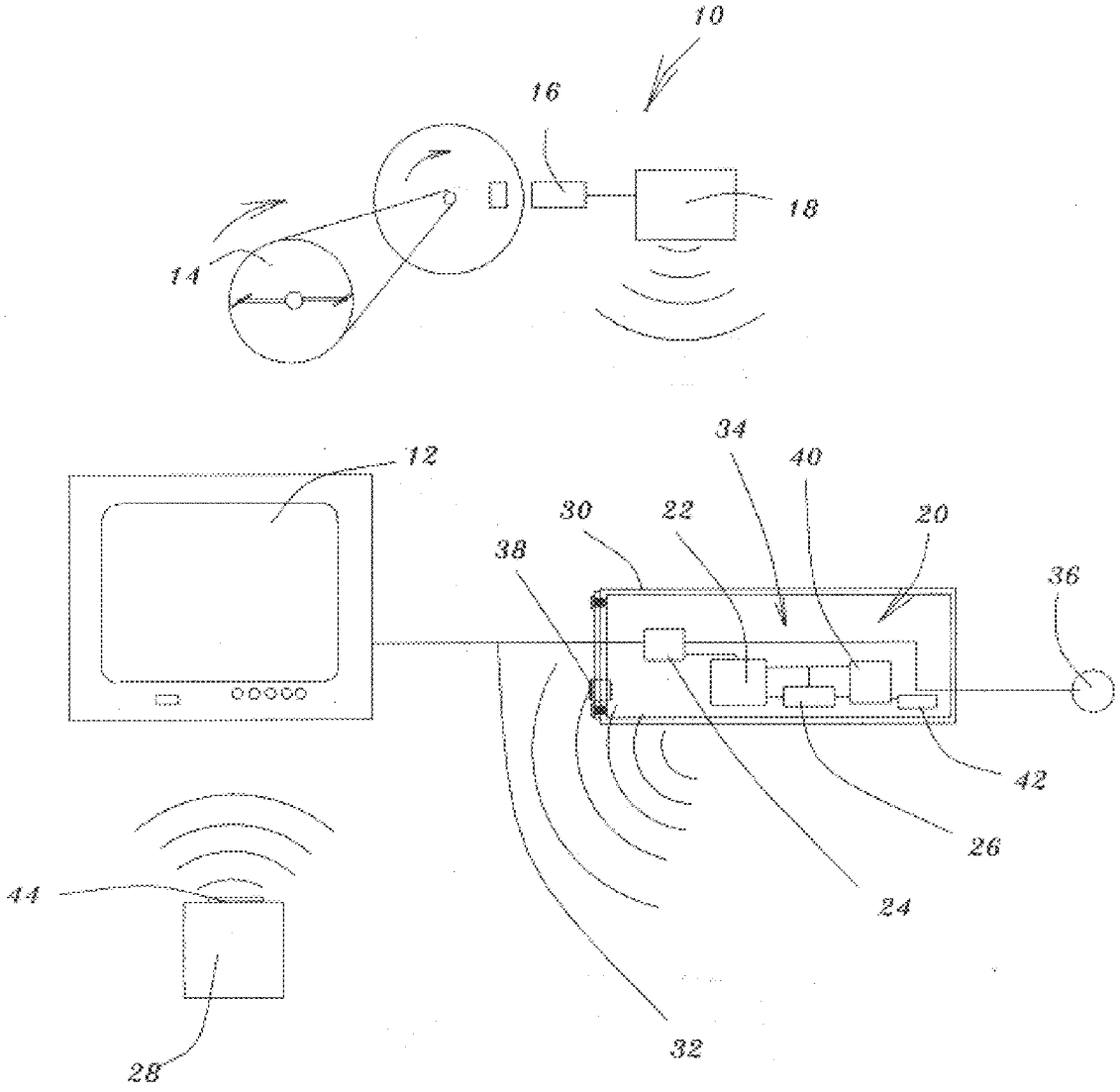
FIG. 1 is a schematic view of a switching apparatus according to the present invention.

FIG. 1 is a schematic view of a switching apparatus generally designated 10 according to the present invention. The switching apparatus 10 is used for switching on a TV 12 as a reward when a user is achieving a predetermined performance level on an exercise apparatus 14. The switching apparatus 10 includes a pulse generator 16 for generating pulses commensurate with the amount of work expended by the user on the exercise apparatus 14 and a transmitter 18 for transmitting the pulses. A transceiver TV module 20 receives the pulses from the transmitter 18, the transceiver module 20 including a pulse counter 22 for counting the pulses received from the transmitter 18. Additionally, the module 20 includes a power sensor 24 for sensing the power status of the TV 12 and a comparator circuit 26 connected to the pulse counter 22 and the power sensor 24. When the TV 12 is plugged in for the first time, the power sensor 24 will determine the power required or power rating for any type of TV. The arrangement is such that when the power sensor 24 senses the to status of the TV 12 as being inactive, the comparator circuit 26 compares the pulses counted by the counter 22 with a threshold level which corresponds with the predetermined factory preset performance level so that when the pulses reach a level of the threshold level, a signal is generated. However, when the power sensor 24 senses the status of the TV 12 as being active, the comparator circuit 26 compares the pulses with the threshold level such that when the pulses reach a level that is less than the threshold level, a further signal is generated so that the module 20 transmits the signal and the further signal accordingly. A receiver 28 is disposed in operable proximity to the TV 12. The arrangement is such that when the receiver 28 receives the signal, the TV 12 is activated. Conversely, when the further signal is received by the receiver 28, the TV 12 is inactivated such that overriding the status of the TV 12 is inhibited so that watching the TV 12 without reaching the predetermined performance level is prevented.

In a more specific embodiment of the present invention, the pulse generator 16 generates the pulses which are electrical signals, the pulses increasing in proportion with the amount of work expended by the user during a unit of time. Also, the transmitter 18 transmits the pulses as R.F. waves to the transceiver TV module 20.

The transceiver TV module 20 further includes a selectively lockable housing 30, a power cord 32 extending from the TV 12 to within the lockable housing 30, an electrical circuit generally designated 34 for electrically connecting the power cord 32 to a source of electrical power 36. The module 20 also includes a lock 38 for locking the housing 30 such that plugging the power cord 32 directly into the source of electrical power 36 or another source of electrical power is prevented so that the overriding of an inactive status of the TV 12 is inhibited.

The power sensor 24 senses the status of the TV 12 as being active when the TV picture tube is on and as being inactive when the TV picture tube is off.

Moreover, the comparator circuit 26 further includes means 40 for checking the pulses if the status of the TV 12 is active and if the pulses have dropped below the level of the threshold level. A time delay mechanism 42 is included for delaying transmission of the further signal so that the status of the TV 12 is deactivated after a predetermined period of time so that if the user momentarily relapses from achieving the predetermined performance level, the TV 12 is not immediately deactivated.

The receiver 28 includes a remote LED 44 disposed in operable proximity to the TV 12, the remote LED 44 controlling a remote actuation of the TV 12 for switching the TV 12 from an inactive to an active status, and an active to an inactive status as programmed.

In operation of the apparatus 10, the pulse generator 16 is a commonly used existing or easily adaptable pulse signal generator and the transceiver TV module 20 receives, processes and transmits pulses to the receiver 28 depending upon the user's actions and activates or deactivates the TV. The module 20 processes pulse data that is received from the transmitter 18. Such pulses are counted, processed and transmitted depending on the work output and the TV power status.

Figure 2:
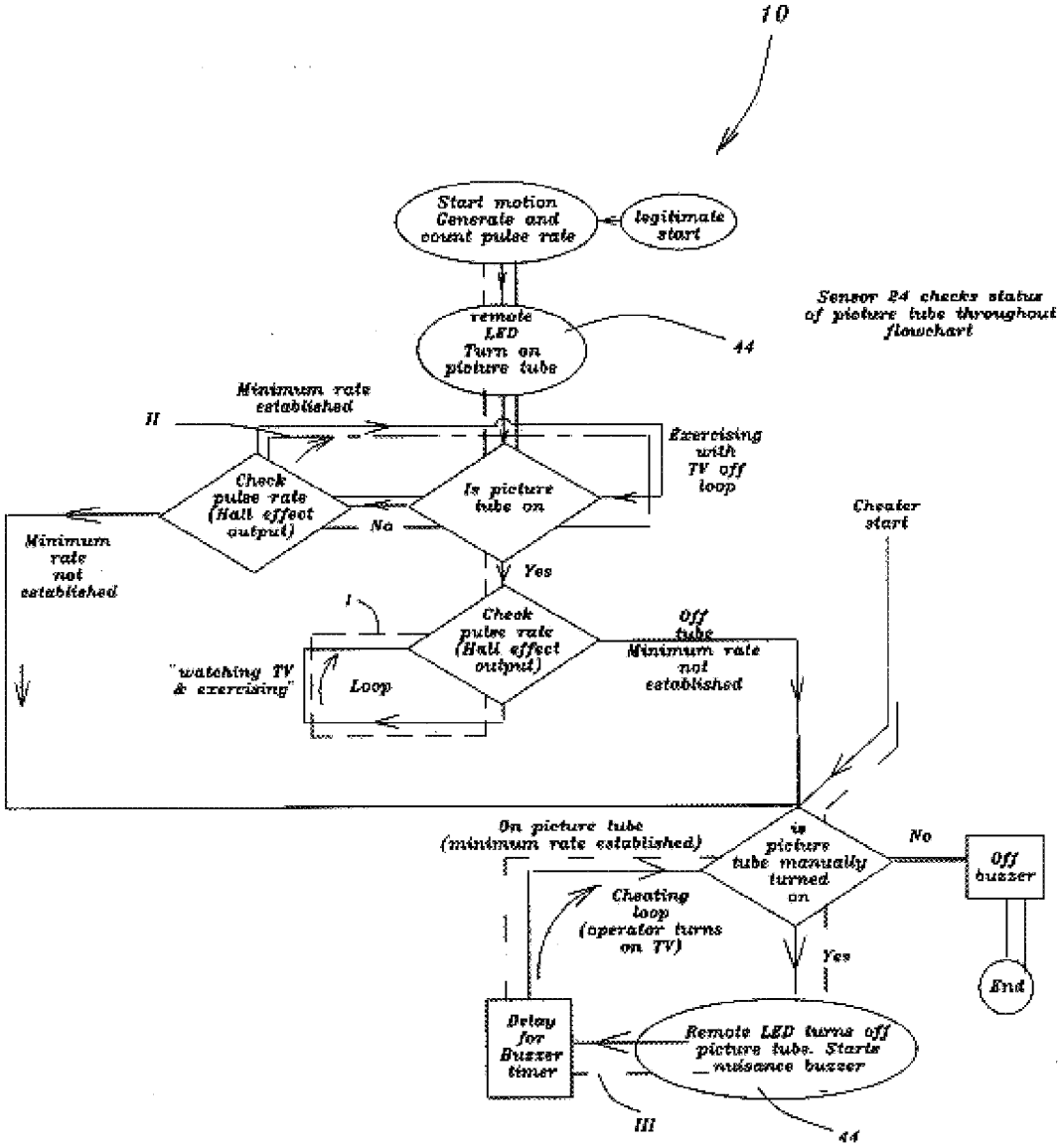
FIG. 2 is a flow diagram showing the operation of the switching apparatus shown in FIG. 1.

The apparatus according to the present invention is mostly wireless and gives the user several options as to its use as follows:

1) Mode 1: The user starts exercising. If the user wishes to watch TV and maintains the necessary work level, the TV turns on automatically. When the user is finished exercising, the TV will turn off automatically. In FIG. 2, the path of Mode 1 is indicated by the numeral I.
2) Mode 2: The user wants to exercise but doesn't want to watch the TV. The user can either exercise below the predetermined threshold level and the TV will never turn on. (This situation is unlikely to occur). Rather, the user simply manually turns the TV off and continues to exercise with the TV off. In FIG. 2, the loop path of Mode 2 is indicated by the numeral II. If the user in Mode 2 with the TV tube turned off and at the required work level decides to turn the picture tube back on when a favorite show for example comes on, the user manually turns the picture tube back on and proceeds downward into the loop path marked "watching TV and exercising".
3) Mode 3: The user is watching TV, as in mode I for example and decides to stop exercising. The TV turns off automatically, but the user now tries to override the system by turning the TV back on manually. Accordingly the cheat loop shown in FIG. 2 becomes operative as indicated by the path marked with the numeral III.
4) Mode 4: A person simply turns on the TV with a hand held remote without ever getting on the exercise machine. The power sensor which detects when the picture tube is on or off detects the action and proceeds as in Mode 3 described above.

The present invention provides a unique apparatus which rewards a user when achieving a predetermined exercise level while preventing a person from overriding the system without exercising to the required level.

What is claimed is:

1. A switching apparatus for switching on a TV as a reward when a user is achieving a predetermined performance level on an exercise apparatus, said switching apparatus comprising:

a pulse generator for generating pulses commensurate with the amount of work expended by the user on the exercise apparatus;

a wireless transmitter for transmitting said pulses;

a wireless transceiver TV module for receiving said pulses from said transmitter;

said transceiver module including:

a pulse counter for counting said pulses received from said transmitter;

a power sensor for sensing the power status of the TV;

a comparator circuit connected to said pulse counter and said power sensor such that when said power sensor senses the status of the TV as being inactive, said comparator circuit compares said pulses counted by said counter with a threshold level which corresponds with said predetermined performance level so that when said pulses reach said threshold level, a signal is generated and when the power sensor senses the status of the TV as being active, the comparator circuit compares the pulses with the threshold level such that when the pulses reach a level that is less than the threshold level, a further signal is generated, said module transmitting said signal and said further signal accordingly; and a wireless receiver disposed in operable proximity to the TV the arrangement being such that when said receiver receives said signal, the TV is activated and when said further signal is received by said receiver, the TV is inactivated such that overriding the status of the TV is inhibited so that watching the TV without reaching the predetermined performance level is prevented.

2. A switching apparatus as set forth in claim 1 wherein said pulse generator generates said pulses which are electrical signals, said pulses increasing in proportion with the amount of work expended by the user during a unit of time.

3. A switching apparatus as set forth in claim 1 wherein said transmitter transmits the pulses as R.F. waves to said module.

4. A switching apparatus as set forth in claim 1 wherein said transceiver TV module further includes:

a selectively lockable housing;

a power cord extending from the TV to within said lockable housing;

an electrical circuit for electrically connecting said power cord to a source of electrical power;

a lock for locking said housing such that plugging said power cord directly into a source of electrical power is prevented so that said overriding of an inactive status of the TV is inhibited.

5. A switching apparatus as set forth in claim 1 wherein said power sensor is arranged such that when the TV is plugged in for the first time, the power sensor will determine the power required for any type of TV.

6. A switching apparatus for switching on a TV as a reward when a user is achieving a predetermined performance level on an exercise apparatus, said switching apparatus comprising:

a pulse generator for generating pulses commensurate with the amount of work expended by the user on the exercise apparatus;

a transmitter for transmitting said pulses;

a transceiver TV module for receiving said pulses from said transmitter;

said transceiver module including:

a pulse counter for counting said pulses received from said transmitter;

a power sensor for sensing the power status of the TV;

a comparator circuit connected to said pulse counter and said power sensor such that when said power sensor senses the status of the TV as being inactive, said comparator circuit compares said pulses counted by said counter with a threshold level which corresponds with said predetermined performance level so that when said pulses reach said threshold level, a signal is generated and when the power sensor senses the status of the TV as being active, the comparator circuit compares the pulses with the threshold level such that when the pulses reach a level that is less than the threshold level, a further signal is generated, said module transmitting said signal and said further signal accordingly;

a receiver disposed in operable proximity to the TV the arrangement being such that when said receiver receives said signal, the TV is activated and when said further signal is received by said receiver, the TV is inactivated such that overriding the status of the TV is inhibited so that watching the TV without reaching the predetermined performance level is prevented;

said comparator circuit further including:

means for checking said pulses if the status of the TV is active and if said pulses have dropped below said threshold level; and a time delay mechanism for delaying transmission of said further signal so that the status of the TV is deactivated after a predetermined period of time so that if the user momentarily relapses from achieving the predetermined performance level, the TV is not immediately deactivated.

7. A switching apparatus as set forth in claim 1 wherein said receiver includes:

a remote LED disposed in operable proximity to the TV, said remote LED controlling a remote actuation of the TV for switching the TV from an inactive to an active status, and an active to an inactive status as programmed.

* * * * *